US005851008A

United States Patent [19]

Dilanchian et al.

[11] Patent Number: 5,851,008

[45] Date of Patent: Dec. 22, 1998

[54] PAPER HANDLING APPARATUS

[75] Inventors: Heros Dilanchian, Lane Cove; Miro Mackiewicz, Ryde; Christopher Malouf, Chatswood, all of Australia

[73] Assignee: Intelmail Australia Ptd. Ltd., Australia

[21] Appl. No.: 730,702

[22] Filed: Oct. 11, 1996

[30] Foreign Application Priority Data

Oct. 12, 1995 [AU] Australia ..... PN5961

[51] Int. Cl.[6] ..... B65H 5/22

[52] U.S. Cl. ..... 271/4.07; 271/35; 271/212; 271/213; 271/223; 271/242; 414/788.9; 414/794.9; 414/789.9

[58] Field of Search ..... 414/795, 788.9, 414/794.9, 789.9, 790.3; 271/4.07, 4.1, 10.08, 10.11, 10.12, 233, 234, 242, 81, 314, 209, 212, 213, 223, 3.01, 35, 125

[56] References Cited

U.S. PATENT DOCUMENTS

| | | | |
|---|---|---|---|
| 3,871,539 | 3/1975 | Nikkel | 271/212 |
| 4,621,966 | 11/1986 | Luperti et al. . | |
| 4,721,229 | 1/1988 | Dempf et al. | 271/213 |
| 4,826,383 | 5/1989 | Millen . | |
| 5,006,903 | 4/1991 | Stearns | 271/125 |
| 5,104,282 | 4/1992 | Gleason . | |
| 5,123,639 | 6/1992 | Edwards | 271/212 |
| 5,147,092 | 9/1992 | Driscoll et al. | 271/212 |
| 5,244,198 | 9/1993 | Green | 271/35 |
| 5,244,200 | 9/1993 | Manzke | 271/212 |
| 5,253,861 | 10/1993 | Schmaling | 271/209 |
| 5,411,252 | 5/1995 | Lowell . | |
| 5,655,761 | 8/1997 | Sanchez | 271/212 |

FOREIGN PATENT DOCUMENTS

| | | |
|---|---|---|
| 0 528 493 | 2/1993 | European Pat. Off. . |

*Primary Examiner*—H. Grant Skaggs
*Attorney, Agent, or Firm*—Fredrikson & Byron, PA

[57] ABSTRACT

A paper handling device adapted to allow for the size of an accumulator region to be varied is disclosed. Apparatus 1 includes a feed section 2, and an accumulation region 3. Paper is fed into accumulation region 3 by roller 16, and out of accumulation region 3 via rollers 26. Thus, there are no belts extending across the accumulation region, and its size can be readily altered by mutual movement of track parts 19, 20. This allows for different sized paper to be easily accommodated.

23 Claims, 3 Drawing Sheets

PAPER HANDLING APPARATUS

TECHNICAL FIELD

The present invention relates to paper handling apparatus, and in particular, to apparatus for accumulating loose sheets of paper at an intermediate stage of processing, for use in mail handling systems and the like.

BACKGROUND ART

Existing mechanisms are known which are used to transfer sheets of paper from a stack of loose sheets, one at a time, for collecting or accumulating a predetermined number of sheets, or for feeding sheets into a folding mechanism. These mechanisms typically use a large number of continuous belts and have a number of disadvantages.

During normal operation, the progress of sheets of paper through such a paper handling machine may be halted temporarily, either as one part of a process, or whilst the sheets are waiting to begin another processing stage. When the sheets of paper are halted, the belts used to transfer the paper continue to operate, making sliding contact with the paper. Certain types of ink, or ink which isn't completely dry, may smudge due to the belts rubbing over the ink. Also, the belts may become dirty after long periods of operation, which may then leave marks on the paper when the belts rub against it. Particular types of belts may become charged with static electricity from the sliding contact, which can disrupt the operation of sensitive electronic components.

These conventional paper handling machines are typically designed to handle a variety of sizes of paper, eg. ranging from international size A5 to A3. However, these conventional machines are generally time consuming to adjust to different paper sizes, and generally require precision adjustments to adapt to a new paper size. Also, small sheets of paper may travel excessive distances due to the machine being sized to handle larger sizes, increasing the chance of marking or damage to the sheets. In most situations, it is not cost effective to provide a machine adapted to each particular paper size.

It is an object of the present invention to provide an improved accumulation arrangement for paper handling, so that the speed and quality of the paper handling is improved. It is a further object to provide an accumulation arrangement in which the size of paper handled can be readily altered.

SUMMARY OF THE INVENTION

According to one aspect, the present invention provides a paper handling apparatus, comprising a feeder device adapted to feed single sheets of paper from a stack, an accumulator for holding one or more sheets fed from said feeder, and an ejector for removing said one or more sheets from said accumulator for subsequent processing, characterised in that said accumulator and said ejector are arranged so that said ejector removes said sheets using beltless means.

Preferably, said ejector comprises roller means.

Preferably, the accumulator is arranged so as to be adjustable in length by relative movement of the ejector and feeder.

This arrangement allows for damage to the paper to be minimised, as belts are not required in the accumulation stage. Moreover, as there are no belts traversing the accumulation region, the size of this region and hence the size of paper handled can be adjusted by simply moving the feeder device relative to the ejector device, so as to define a larger or smaller region between them as the accumulation region.

The feeder device may conveniently move on tracks to approach and retreat linearly.

A further disadvantage of conventional paper handling machines is the inability of the machines to alter the order in which single sheets are accumulated. For instance, a machine which feeds pages from the bottom of a stack of pages will accumulate the page in the same order in which they were stacked, i.e. the sheet which was on the bottom of a stack of sheets remains on the bottom of the accumulated group of sheets. Likewise, machines which feed from the top of a stack of sheets will normally accumulate sheets in the reverse order, the sheet which was on the top of the stack will be the bottom sheet of a group of sheets.

The present invention in a preferred implementation allows for the provision of a ramp and accumulation region which permit either under or over feeding of sheets into the accumulation region.

BRIEF DESCRIPTION OF THE DRAWINGS

A preferred form of the invention will now be described with reference to the accompanying drawings, wherein.

DETAILED DESCRIPTION OF THE PREFERRED EMBODIMENT

Figure 1:
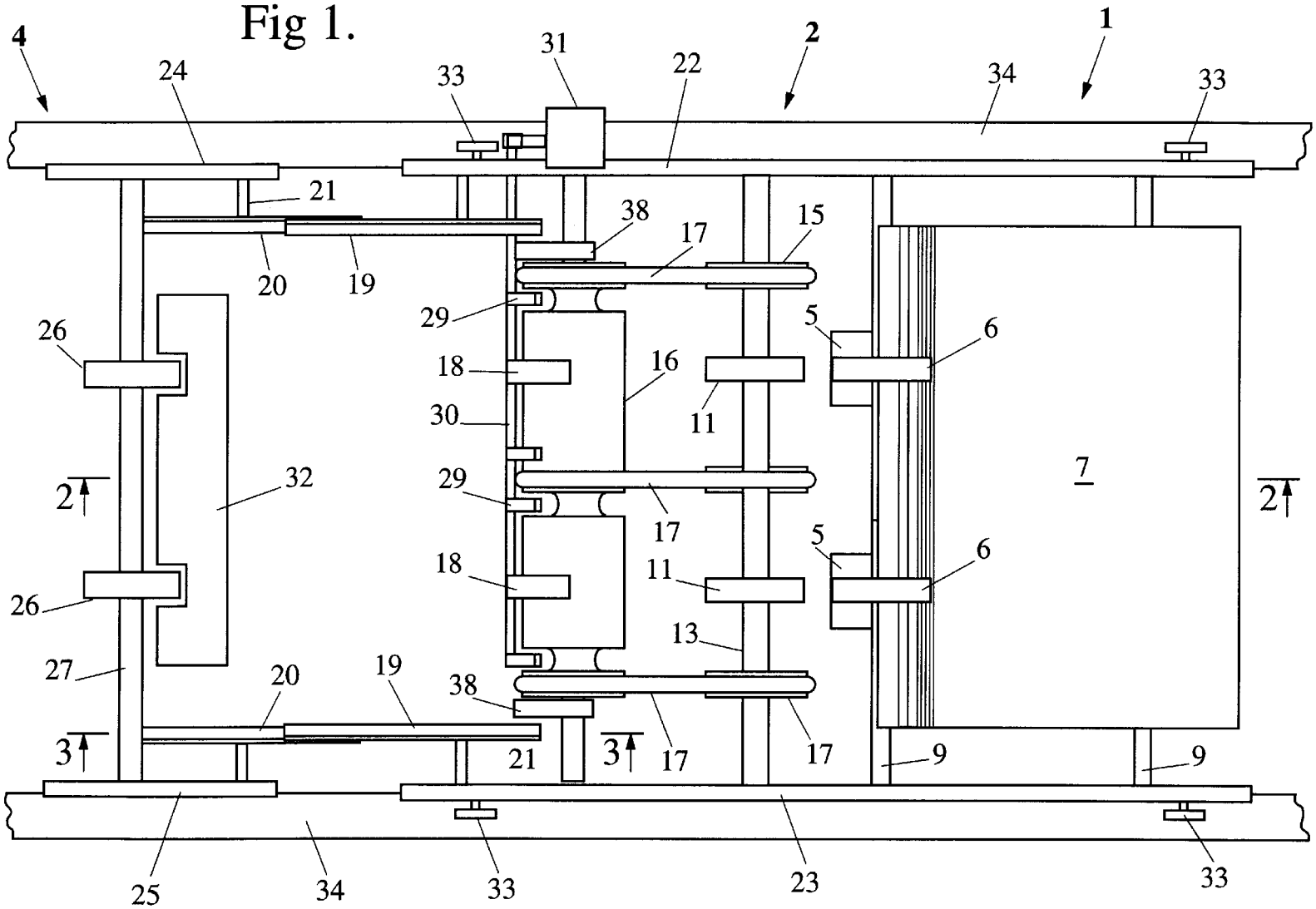
FIG. 1 is a schematic plan view of a paper handling apparatus.

A preferred embodiment of the present invention will now be described. It will be understood that the arrangement disclosed is only illustrative, and alternative embodiments are possible which implement the principles of the present invention. The paper handling apparatus 1 shown in the drawings has been shown schematically and depicts a paper handling apparatus in simplified form. For example, bearings, supporting members and the means used to drive the various components have not been shown. Typically, the various shafts will be belt driven from electric motors or other shafts, with clutch and brake mechanisms as required. However, the use of gear drives, stepper motors, or pneumatic drives may be preferred to satisfy particular design conditions.

Figure 2:
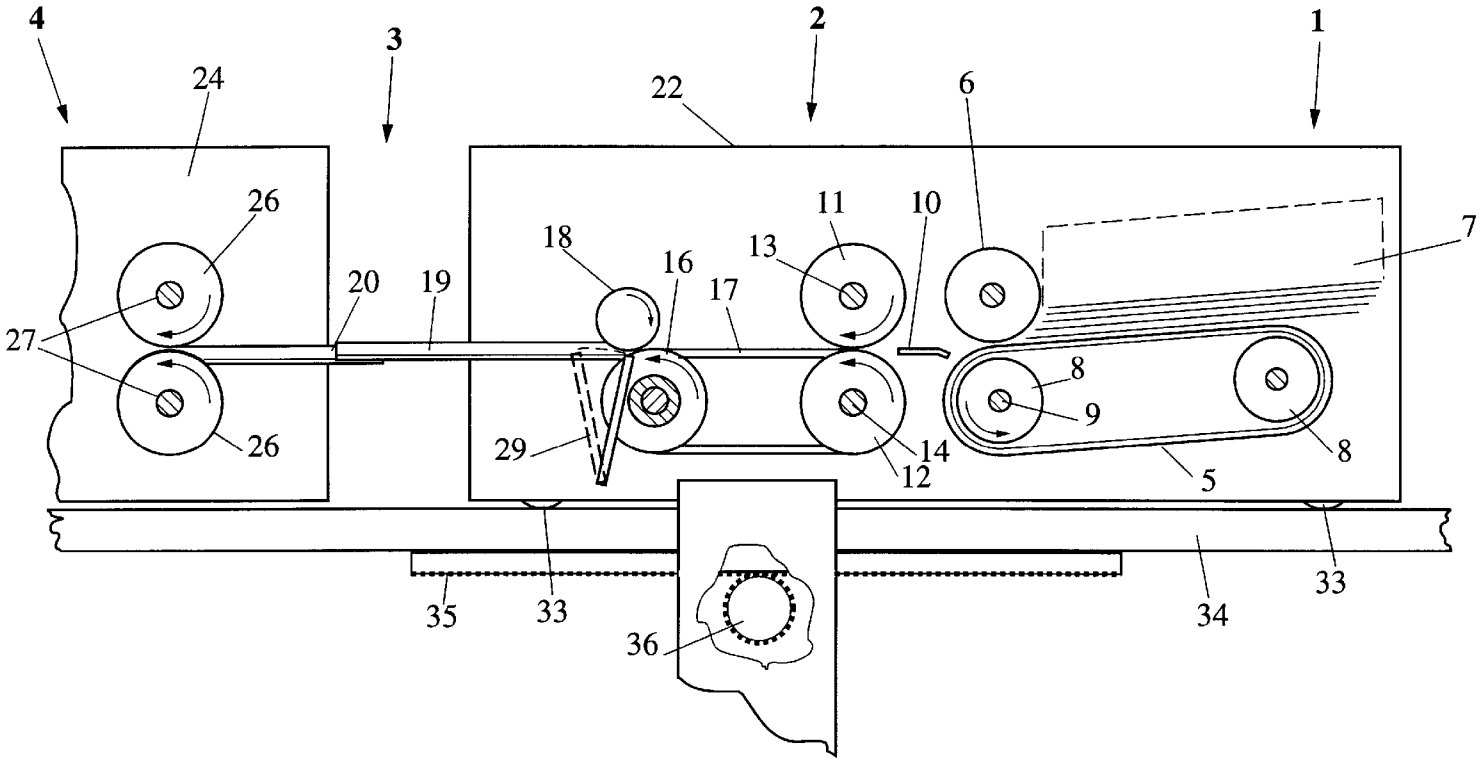
FIG. 2 is a schematic sectional view of the invention of FIG. 1 taken along 2—2.

Referring to FIG. 2, the paper handling apparatus 1 generally comprises a feed section 2, an accumulation region 3 and a folder 4, It should be noted that the folder 4 is shown only schematically, and can be replaced by mechanisms for performing other operations. Alternatively, there may be no further devices downstream of the accumulation region 3, the apparatus 1 simply being used to count a predetermined number of sheets from a stack of loose leaf sheets.

The feeder 2 shown has a pair of feed belts 5, fixed rollers 6 and a stack of loose sheets 7 positioned upon the feed belts 5. Each feed belt 5 is mounted on a pair of rollers 8 on shafts 9, only one of which need be driven. Typically, there will be more than one feed belt 5 and fixed roller 6 disposed in parallel to support the sheets 7, and additional rollers may be mounted on the shafts 9 to aid feeding and support of the paper 7. The gap between the feed belt 5 and fixed roller 6 is adjustable and is desirably set to the thickness of a single sheet of the paper being fed, so that upon movement of the belt 5 in the direction indicated by the arrow, one of the sheets 7 Is fed from the feed section 2. The operation of the feed belt 5 is typically controlled by a microprocessor (not shown), so that the sheets 7 are only fed as required, and sensors may be provided to halt the operation of the machine if more than one sheet is fed at a time, or some other fault occurs. Other types of mechanisms for feeding single sheets, as are known to those skilled in the art, may be used instead of the mechanism described above, eg. mechanisms which feed from the top of the stack 7.

A sheet 7 fed past the fixed roller 6 is directed by a deflector plate 10 (omitted from FIG. 1 for clarity—see FIG. 2) towards and between upper and lower rollers 11, 12. These rollers are continually driven in the direction shown by the arrows. In the embodiment shown, there are two upper rollers 11 mounted on upper shaft 13 mounted directly above and in pressing contact with a pair of lower rollers 12 mounted on a lower shaft 14. Three lower pulleys 15 disposed alternatively with the lower rollers 12 are all mounted on the lower shaft 14. The upper and lower shafts 13, 14 are controlled so as to rotate at the same speed in opposite directions by means of gears, rollers, a combination of belts and pulleys or any other suitable means.

An eject roller 16 is linked to the lower pulleys 15 by several belts 17. The belts 17 rotate the eject roller 16 and carry sheets passing between the upper and lower rollers 11, 12. Several spaced apart belts 17 are preferred to support the sheet in a substantially flat, horizontal orientation. A pair of guide rollers 18 are provided to guide a sheet fed from the upper and lower rollers 11, 12 to ensure the sheet follows the correct path, The shaft mounting the guide rollers 18 has not been shown for reasons of clarity. Preferably the guide rollers 18 are elastically mounted so as to be biased towards the eject roller 16. Ramps 38 aid in directing the motion of the paper, as will be described further below.

Along each side of the accumulation region 3 of the apparatus 1 is provided a two part paper track 19, 20. Each paper track comprises a rear track part 19 and a front track part 20, both of which are of a generally I-shaped cross section and are adapted for supporting the edges of one or more sheets of paper. Each track support part 19, 20 is held in position by one or more adjustable supports 21, the length of which can be altered to suit different width sheets of paper. A central paper support may also be provided if desired (not shown) between the paper track parts 19, 20 to support the centre of sheets of paper in the accumulation region 3. The central paper support can also be variable in width and attached to opposed paper track parts. The rear paper track parts 19 are supported by the feeder side panels 22, 23 and the front paper track parts by the folder side panels 24, 25.

It will be understood that alternative tracks with variable length could be used, in place of tracks 19, 20, to provide equivalent functionality.

Figure 3:
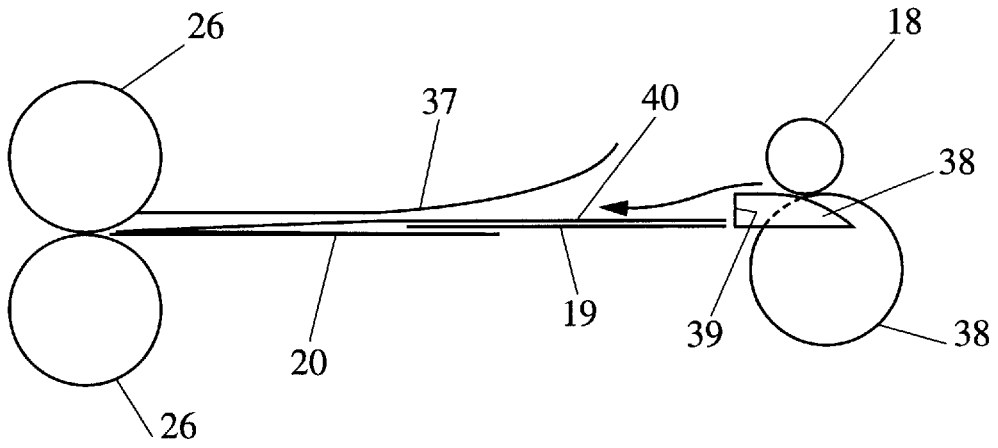
FIG. 3 is a schematic sectional view of the invention of FIG. 1 taken along 3—3.

Upper paper track parts 37 (shown in FIGS. 3 and 4) may be provided to limit upward movement of the paper. As the paper passes over the eject roller 16, the movement of the leading edge of the sheet of paper through the air may cause it to lift upwards, loading to uncontrolled movement of the paper, possibly leading to the sheet of paper leaving the apparatus altogether. The upper paper tracks 37 are shaped so that the gap between the upper paper tracks 37 and the front and rear paper tracks 19, 20 decreases in the direction away from the eject roller 16, enabling the paper to easily feed between the tracks, but greatly restricting the movement near the folder inlet rollers 26. The upper tracks 37 may be provided as front and rear parts, similar to track parts 19 and 20.

The momentum of the sheets of paper being transported between the eject and guide rollers 16, 18 causes the paper to continue to move until each sheet abuts against the folder inlet rollers 26. The arrow in FIG. 3 indicates the normal path of travel. The folder inlet rollers 26 mounted on shafts 27 are normally stationary. The accumulation region 3 is provided so that a predetermined number of sheets may be fed from the stack of sheets 7, to be passed onto the next stage for processing as a group, in this case folding.

Figure 4:
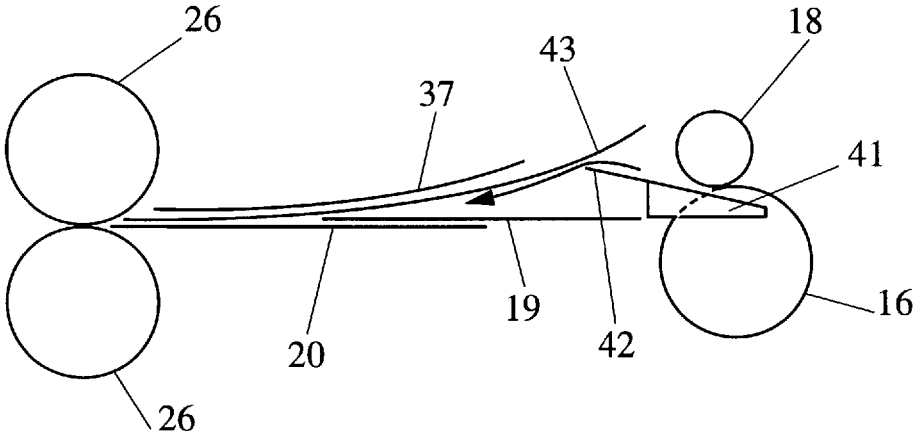
FIG. 4 is a schematic sectional view similar to that of FIG. 3 showing alternative accumulation ramps.

Ramps 38 (FIG. 3) may be provided on each side of the eject roller 16 to ensure the correct movement and accumulation of the paper. When the paper handling apparatus 1 is operating at high speeds, the sheets of paper 40 fed by the eject roller 16 have a considerable momentum, and may bounce backwards after contacting the folder inlet rollers 26. Backwards movement of the paper 40 is restricted by the rear edge 39 of the ramps 38, and the sheets of paper 40 are neatly accumulated between the folder inlet rollers 26 and ramps 38. Not only do the ramps 38 aid in neatly accumulating the fed paper, but also prevent the paper contacting the rotating eject roller 16, which could mark or damage the paper, Alternative ramps 41 (FIG. 4) are used for under accumulation of paper. Under accumulation results in the paper being accumulated in the reverse order to that described above, as subsequent sheets are fed under, rather than over, the preceding sheet. In the embodiment described in FIG. 3, the distance between the folder inlet rollers 26 and the rear edge 39 is set to be slightly greater than the length of paper being accumulated. In the embodiment of FIG. 4, however, the distance between the folder inlet rollers 26 and the trailing edge 42 of under accumulation ramp 41 is less than the length of the sheet of paper 43. The distance is determined by the size and flexibility of the paper 43. As is shown in FIG. 4, the rear portion of the sheet 43 is arcuate and curves upwards to rest upon the trailing edge 42. Subsequent sheets of paper fed by the eject roller 16 follow the path indicated by the arrow, to be fed between the sheet 43 and the trailing edge 42.

The eject roller 16 has a number of circumferential grooves 28, in which are disposed kicker fingers 29. The kicker fingers 29 of the present invention are mounted on a kicker shaft 30 (omitted from FIG. 2), and a solenoid 31 is provided to rotate the kicker shaft 30 through a small angle. The kicker fingers 29 are not normally in contact with the sheets of paper either as the paper passes the eject roller 16 or when the paper is resting on the paper track parts 19, 20. Operation of the kicker fingers 29 causes the fingers 29 to move from their rest position out of the grooves 30, into contact with the trailing edges of the sheets in the accumulation region 3. The movement of the kicker fingers 29 causes the sheets in the accumulation region 3 to be precisely aligned with one another and be pressed against the folder rollers 26, The folder rollers 26 are then operated to draw the aligned sheets evenly into the folder 4. One or more guide plates 32 can be provided to aid feeding the sheets between the folder rollers 26. The guide plate 32 shown in FIG. 1 has been omitted from FIG. 2 for clarity, but is horizontal and approximately in line with the lower edges of the front paper track parts 20.

If the paper handling apparatus is provided with under accumulation ramps 41, then the kicker shaft 30 would normally be positioned above the ramps 41. In the rest position. the kicker fingers 29 extend above the eject roller 16, and upon actuation are pivoted to move downwards and against the trailing edges of the accumulated sheets of paper, urging them towards the folder inlet rollers 26.

The solenoid 31 shown is a linear solenoid acting on a lever mounted on kicker shaft 30, so as to cause the shaft 30 to rotate upon movement of the lever. A rotary solenoid coupled to the shaft 30 could also be used.

If the kicker fingers 29 were not present, the sheets would be drawn into the folder 4 solely by action of the folder rollers 26, which can cause the sheets to be misaligned. Due to the curvature of the folder rollers 26 and the location of the paper tracks, the leading edges of the sheets may extend between the folder inlet rollers 26 by different amounts. Alternatively, the top and bottom-most sheets may start to feed between the folder rollers 26 before the other sheets resulting in misalignment. Misalignment of misfeeding of the leading edges of the sheets of paper can cause problems, particularly if the sheets are to be folded, resulting in creases or tears or unsightly folds.

The entire feed section 2, from the feed belts 17 to the eject roller 16 and rear paper track parts 19 are fixed together by the side panels 22, 23 so as to be movable as a single unit, relative to the folder 4. The side panels 22, 23, on which the shafts, pulleys, rollers etc are mounted, are supported by slide rollers 33, on a track 34 on each side of the feed section 2. A rack 35 and a pinion 36 are also provided on each side of the feed section 2. This allows the distance between the feed section 2 and folder 4 to be easily varied, preferably by electronic control of a motor driving the pinions 36. The size of the accumulation region 3 can be varied to suit the size of paper being fed, reducing the chance of misalignment of sheets as they are added to the accumulator region 3. The front and rear paper track parts 19, 20 move relative to one another as the feed section 2 is moved, ensuring that the paper tracks extend along the entire length of the accumulation region 3. Electric control of the movement of the pinions 36 allows the adjustment to occur quickly and accurately, without relying on the skill of the operator of the apparatus.

Of course, It will be appreciated that in a suitable implementation, the feeder 2 could be essentially stationary and the folder 4 or other following mechanism, or simply ejector rolls, could be moved. Other arrangements for allowing relative movement could be used.

One form of control of the pinion driving motor is simply one or more switches to control the movement of the feed section in either direction. Other forms of control include fast and slow speed controls, to allow the feed section to be adjusted to the approximate position quickly, and then positioned accurately using the slow speed control. There may even be a variable speed control, such a rotary or sliding switch, where movement of the switch in either direction from a central position determines direction of feed section travel, and the amount of switch movement determines the speed. Another possible form of pinion driving motor control is an electronic control In which particular positions of the feed section are 'memorised', for example using a stepper motor type arrangement, allowing the apparatus to be set up for the sizes of the paper to be used. Such an arrangement allows the apparatus to be adjusted repetitively and accurately.

If required, the paper handling apparatus 1 may further comprise optical mark readers, bar code readers or similar devices for gaining information, such as the number of sheets to be accumulated, as the sheets pass through the feeder 2.

The present invention has the particular advantage that belts are not used in the accumulation region 3, and so there is no rubbing of belts on the sheets of paper as they are accumulated or waiting for further processing, eg. folding.

The quantity of pulleys and rollers outlined above have been found to provide acceptable performance but is in no way intended to be limiting upon the scope of the invention. For example, the number of rollers and pulleys may be increased or decreased as required. Various sensors and electronics to monitor or control the operation of the paper handling apparatus may also be used, as is known to those skilled within the art. Furthermore, although the invention has been described with reference to handling paper, it is clearly suited to handling other thin, sheet-like materials. such as card or plastics sheets.

We claim:

1. A paper handling apparatus, comprising a feeder device adapted to feed single sheets of paper from a stack, an accumulator for holding one or more sheets fed from said feeder device, and an ejector for removing said one or more sheets from said accumulator for subsequent processing, the paper being supported by the accumulator and removed by the ejector without coming into contact with a belt, the feeder device being moveable linearly with respect to the ejector so as to vary the size of the accumulator.

2. Apparatus according to claim 1, wherein said ejector comprises roller means.

3. Apparatus according to claim 2, wherein the accumulated sheets are moved into contact with said ejector using kicker means disposed proximate a feeder side of the accumulator.

4. Apparatus according to claim 3, wherein the kicker means comprises fingers located on a shaft connected to the feeder device.

5. Apparatus according to claim 1, wherein the accumulator comprises first and second interconnected track means extending across the accumulator, said first track means connected to the ejector and said second track means connected to the feeder device, so that as the distance between the feeder device and the ejector is varied, said first and second track means slide relatively to provide a continuous support for sheets in said accumulator.

6. Apparatus according to claim 5, wherein a motor is arranged to provide relative movement between the feeder device and the ejector.

7. Apparatus according to claim 1, wherein the feeder device includes opposed elements for feeding single sheets arranged so that the space between the opposed elements of the feeder device is less than the thickness of two sheets of the sheets to be fed.

8. Apparatus according to claim 7, wherein the apparatus further comprises a stacker ramp adapted for guiding the path of individual sheets of paper during feeding from said feeder device, and stop means in said accumulator for halting the motion of a fed sheet of paper, wherein:

said stacker ramp has an accumulator side edge which is disposed proximate to and is elevated above the accumulator, and the distance between said stop means and said accumulator side edge of said stacker ramp is greater than the length of said sheets, so that when a first sheet of paper is fed by said feeder device its motion is halted by the stop means, with the trailing edge of the first sheet remaining on said ramp, so that subsequently fed sheets will accumulate under said first sheet.

9. A paper handling apparatus, comprising:

an accumulator adapted to hold one or more sheets of paper in stacked relationship, the accumulator having an accumulator region in which the sheets of paper are supported without coming into contact with driven conveyor belts or rollers during accumulation of paper in and prior to being removed from the accumulator, the accumulator region extending between a linear motion sheet feeder device and an ejector device;

the linear motion sheet feeder device being disposed upstream of said accumulator and adapted to feed single sheets of paper to said accumulator in linear motion from a paper supply;

the ejector device being disposed downstream of said accumulator and adapted to remove said one or more of the stacked sheets of paper from said accumulator for subsequent processing;

a kicker device disposed proximate a feeder side of the accumulator and having a kicker positioned to engage the stacked sheets of paper in said accumulator to align the sheets of paper and move the stacked sheets of paper into position for removal by the ejector device; and means for adjusting the length of said accumulator region to support paper sheets of varying length.

10. Apparatus according to claim 11, wherein said ejector device comprises a pair of rollers disposed in radially facing relationship such as to enable drawing of said one or more of the stacked sheets of paper therein between upon operation of said rollers, thereby to effect the removal of the stacked sheets from said accumulator.

11. Apparatus according to claim 10, wherein said rollers are arranged to remain stationary during accumulation of said one or more of the stacked sheets of paper in said accumulator.

12. Apparatus according to claim 10, wherein said kicker comprises a plurality of fingers mounted on a shaft, said fingers arranged for limited rotational movement between a first position in which they allow unrestricted passage of said sheets of paper from said feeder device into said accumulator, and a second position in which they are brought into contact with trailing edges of said sheets stacked in the accumulator, and wherein said fingers are arranged such that their movement causes said sheets in the accumulator to be pressed against the rollers of said ejection device.

13. Apparatus according to claim 9, wherein said kicker comprises a plurality of fingers mounted on a shaft, said fingers arranged for limited rotational movement between a first position in which they allow unrestricted passage of said sheets of paper from said feeder device into said accumulator, and a second position in which they are brought into contact with trailing edges of said stacked sheets in the accumulator.

14. Apparatus according to claim 9, wherein said feeder device and said ejector device are arranged for linear, reciprocating movement with respect to one another, said accumulator region being defined between said ejector and feeder device.

15. Apparatus according to claim 14, wherein said accumulator comprises first and second, slideably engaging track members extending along the length of said accumulator region, said first track members being secured at said ejector device on opposite widthwise sides of said accumulator area, and said second track members being secured at said feeder device on opposite widthwise sides of said accumulator area.

16. Apparatus according to claim 15, wherein said accumulator further comprises a drive apparatus for varying the distance between said ejector and feeder devices, said first and second track members having support areas for supporting said sheets and being arranged to slide telescopically relative to one another whilst providing continuous side edge support for said sheets received in said accumulator region.

17. Apparatus according to claim 9, wherein said feeder device comprises an endless belt conveyor and a roller disposed above said belt conveyor, said roller being supported for adjustable movement with respect to said conveyor to adjust a gap between a peripheral surface of said roller and a surface of said belt conveyor to a distance less than the thickness of two stacked sheets of paper to be fed to said accumulator.

18. A paper handling apparatus, comprising:

an accumulator adapted to hold one or more sheets of paper in stacked relationship, the accumulator having an accumulator region in which the sheets of paper are supported without coming into contact with driven conveyor belts or rollers during accumulation of paper in and prior to being removed from the accumulator, the accumulator region extending between a linear motion sheet feeder device and an ejector device;

the linear motion sheet feeder device being disposed upstream of said accumulator and adapted to feed single sheets of paper to said accumulator in linear motion from a paper supply;

the ejector device being disposed downstream of said accumulator and adapted to remove said one or more of the stacked sheets of paper from said accumulator for subsequent processing;

a kicker device disposed proximate a feeder side of the accumulator and having a kicker positioned to engage the stacked sheets of paper in said accumulator to align the sheets of paper and move the stacked sheets of paper into position for removal by the ejector device;

means for adjusting the length of said accumulator region to support paper sheets of varying length;

a stop disposed in said accumulator for halting the motion of said individual sheets of paper being fed; and at least one stacker ramp for guiding the movement path of individual sheets of paper during feeding of said sheets from said feeder device, the stacker ramp having an accumulator-side edge which in operation of the apparatus is elevated above a sheet support plane defined within said accumulator region, said stacker ramp being located such that the distance between said stop and said accumulator-side edge of said stacker ramp is greater than the length of a sheet of paper to be received in said accumulator, the arrangement of the accumulator, the stacker ramp and the stop in relation to one another being such that, in operation of the apparatus, when a first sheet of paper is fed by said feeder device its motion is halted by said stop with the trailing edge of said first sheet remaining on said stacker ramp, whereby subsequently fed sheets of paper will accumulate underneath said first sheet of paper.

19. Apparatus according to claim 18, wherein said ejector device comprises a pair of rollers disposed in radially facing relationship such as to enable drawing of said one or more of the stacked sheets of paper therein between upon operation of said rollers, thereby to effect the removal of the stacked sheets from said accumulator.

20. Apparatus according to claim 19, wherein said rollers are arranged to remain stationary during accumulation of said one or more of the stacked sheets of paper in said accumulator.

21. Apparatus according to claim 19, wherein said kicker comprises a plurality of fingers mounted on a shaft, said fingers arranged for limited rotational movement between a first position in which they allow unrestricted passage of said sheets of paper from said feeder device into said accumulator, and a second position in which they are brought into contact with trailing edges of said sheets stacked in the accumulator, and wherein said fingers are arranged such that their movement causes said sheets in the accumulator to be pressed against the rollers of said ejection device.

22. Apparatus according to claim 18, wherein said kicker comprises a plurality of fingers mounted on a shaft, said fingers arranged for limited rotational movement between a first position in which they allow unrestricted passage of said sheets of paper from said feeder device into said accumulator, and a second position in which they are brought into contact with trailing edges of said stacked sheets in the accumulator.

23. Apparatus according to claim 18, wherein said feeder device comprises an endless belt conveyor and a roller disposed above said belt conveyor, said roller being supported for adjustable movement with respect to said conveyor to adjust a gap between a peripheral surface of said roller and a surface of said belt conveyor to a distance less than the thickness of two stacked sheets of paper to be fed to said accumulator.

* * * * *